US005996128A

United States Patent [19]

Yanagihara

[11] Patent Number: 5,996,128

[45] Date of Patent: Dec. 7, 1999

[54] AIR FLOW ADJUSTING REAR MEMBER OF THE HELMET

[75] Inventor: Keishu Yanagihara, Osakahu, Japan

[73] Assignee: Korea OGK Co., Ltd., Seoul, Rep. of Korea

[21] Appl. No.: 09/224,526

[22] Filed: Dec. 31, 1998

[51] Int. Cl.[6] ..... A42B 3/04

[52] U.S. Cl. ..... 2/422; 2/425

[58] Field of Search ..... 2/410, 411, 422, 2/424, 425, 171.3, 12

[56] References Cited

U.S. PATENT DOCUMENTS

| | | | |
|---|---|---|---|
| 3,496,854 | 2/1970 | Feldmann et al. | 2/410 |
| 4,564,959 | 1/1986 | Zahn | 2/411 |
| 4,586,197 | 5/1986 | Hubbard | 2/410 |
| 5,097,538 | 3/1992 | Feuling | 2/410 |
| 5,124,848 | 6/1992 | Capilupi, Jr. | 2/410 |
| 5,333,328 | 8/1994 | Roberts | 2/422 |
| 5,575,018 | 11/1996 | Rothrock | 2/424 |

FOREIGN PATENT DOCUMENTS

| | | | |
|---|---|---|---|
| 3305735 | 8/1984 | Germany | 2/410 |
| 3444404 | 6/1986 | Germany | 2/425 |
| 671864 | 10/1989 | Switzerland | 2/410 |

*Primary Examiner*—Michael A. Neas
*Attorney, Agent, or Firm*—Dougherty & Associates

[57] ABSTRACT

An air flow adjusting rear member of a helmet comprises a top portion for suppressing negative pressure generated at a back part of the helmet and is removable from the helmet by using adhesive element for fastening the air flow adjusting rear member to the back part of the helmet. The air flow adjusting rear member is made of thin resin for enough plasticity and elasticity to modify its shape in accordance with a curved surface of the helmet.

5 Claims, 7 Drawing Sheets

AIR FLOW ADJUSTING REAR MEMBER OF THE HELMET

BACKGROUND OF THE INVENTION

1. Field of the Invention

The present invention relates to an air flow adjusting rear member of a helmet.

2. Description of Related Art

When driving a motorcycle at high speed while wearing a helmet, a strong wind pressure acts on the front part of the helmet on the head of a cyclist. The wind passing by the helmet results in negative pressure (turbulence) at the lower back of the helmet and this negative pressure pulls the helmet backward, thereby creating a great stress to the cyclist's neck muscles.

Conventional art provides an air flow adjusting rear member (inverted visor) fixed to the rear portion of a helmet (see U.S. Pat. No. 4,586,197).

This air flow adjusting rear member is designed to be completely fixed with rivets, screws, or adhesive materials.

In other words, the conventional air flow adjusting rear member is fixed to the lower back rim to extend upwardly and rearwardly therefrom and covers the lower back portion of the helmet, thereby allowing maximum relaxing of neck muscles at each speed, depending upon speed of a motorcycle and tilt of the head of a wearer.

Such conventional air flow adjusting rear member is fixed to the helmet and thus cannot be removed when necessary. For example, the air flow adjusting rear member must be removed in at least the following cases: when the air flow adjusting rear member is broken and needs to be replaced with a new one; when a user (rider) wants to replace an air flow adjusting rear member with another having a different color, shape, or size; and when a user wants to use a helmet without an air flow adjusting rear member.

Since the air flow adjusting rear member is fixed and cannot be removed from a helmet, the whole helmet must be abandoned if only the air flow adjusting rear member is damaged even though the body of the helmet is left unbroken. Additionally, a mounting site of the air flow adjusting rear member cannot be adjusted to account for various conditions such as a posture of a rider, an average range of traveling speeds, the direction of the wind, and wind pressure.

In another aspect, when rivets or screws are used to fix the air flow adjusting rear member to a helmet, the body of the helmet is holed, so it is necessary to increase a strength of the helmet in consideration of the holes, thereby increasing the cost of the helmet.

It can be considered to form the air flow adjusting rear member integrally with a helmet at an initial stage. However, this has a problem of requiring many variants of helmets and disadvantages in manufacturing cost or distribution. For users, they may need to purchase both general helmet and helmet with an air flow adjusting function, thereby having a burden economically or practically.

SUMMARY OF THE INVENTION

Accordingly, the present invention is directed to an air flow adjusting rear member of a helmet that substantially overcomes one or more of the limitations and disadvantages of the related art.

An objective of the present invention is to provide an air flow adjusting rear member which can be simply and quickly removed from a helmet.

Another objective of the present invention is to provide a mounting site of an air flow adjusting rear member to a helmet to allow optional adjustments to realize optimum use of the helmet under various conditions.

Yet another objective of the present invention is to provide a helmet which does not require specially increasing the strength of the helmet when an air flow adjusting rear member is mounted to the helmet.

Another objective of the present invention is to eliminate the necessity of separately manufacturing helmets with and without an air flow adjusting function.

Another objective of the present invention is to allow for furnishing/non-furnishing of an air flow adjusting rear member not to impose economical or practical burden on a user.

A further objective of the present invention is to provide a helmet for accomplishing the objectives described above.

Additional features and advantages of the invention are set forth in the description which follows, and in part will be apparent from the description, or may be learned by practice of the invention. The objectives and advantages of the invention will be realized and attained by the structure as illustrated in the written description and claims hereof, as well as the appended drawings.

To achieve these and other advantages, and in accordance with the objectives of the present invention as embodied and broadly described, the following technical means are provided. An air flow adjusting rear member (inverted visor) having a top portion for restraining negative pressure (turbulence) from being generated is designed to be removable from a helmet. Therefore, the air flow adjusting rear member of a helmet according the present invention can be simply and quickly removed from a helmet at any time when necessary. Since the air flow adjusting rear member is initially constructed to be removable from a helmet, detachment of the air flow adjusting rear member can be positively performed without damaging either the air flow adjusting rear member or the helmet, and the air flow adjusting rear member can also be mounted to an existing helmet, thereby reducing neck muscle stress.

An adhesive element such as a gluing agent or an adhesive is used to fasten the air flow adjusting rear member to a helmet, so the air flow adjusting rear member can be placed at any portion on the helmet. This makes it possible to place the air flow adjusting rear member at an optimal location on the helmet according to use conditions.

A double-sided adhesive tape can be used as the adhesive element. If the tape is adherent to the air flow adjusting rear member in advance, fastening the air flow adjusting rear member to the helmet can be accomplished very easily.

The air flow adjusting rear member comprises a top portion backwardly extending from the back surface of a helmet and a rear portion downwardly extending from the lower rim of the top portion. An exact fitting edge is formed along the circumferences of the top portion and rear portion, and tightly contacts the helmet along a curve of the helmet.

Through such configuration, the air flow adjusting rear member can be tightly fastened to a helmet. The exact fitting edge is formed to be a closed loop along the edge of the top portion and rear portion and has a large contact area, thereby increasing intensity of cohesion and giving a visual impression of integration of the air flow adjusting rear member with the helmet.

The exact fitting edge is consecutive and endless, thus preventing air from coming into the inside of the air flow adjusting rear member through a gap between the air flow adjusting rear member and the helmet and preventing the air flow adjusting rear member from coming off the helmet while a wearer is riding a motorcycle.

The top portion and rear portion are made of thin resin material, so they can have predetermined degree of plasticity and/or elasticity. In case where a site to which the air flow adjusting rear member is mounted on the helmet is changed, the exact fitting edge can be easily adapted to a different curve of a body of the helmet. In other words, change of the mounting site of the air flow adjusting rear member on the helmet is available within a predetermined range.

For example, according to its use (e.g., use when riding an autobicycle and use when riding a four-wheeled car), the air flow adjusting rear member can be differently placed on the helmet, and the air flow adjusting rear member can be adaptively mounted to different types of helmets. Consequently, the air flow adjusting rear member of the invention extends the range of usage as a function of reducing stress on a user's neck muscles.

An intermediate plate is formed between the top portion and the rear portion to upwardly and backwardly slant from the rear portion to the top portion, making an acute angle with the back of the top portion, thereby allowing a good break away of the wind and reducing air resistance. Consequently, this configuration allows suppression of negative pressure depending upon wind flow.

The air flow adjusting rear member can be placed on the helmet in such orientation to allow the stream of the wind above the top of the helmet to be approximately parallel to the surface of a road, thus also allowing good break away of the wind and reducing the air resistance, thereby suppressing negative pressure depending upon wind flow.

A mounting site and state of the air flow adjusting rear member is determined not by an angle of the air flow adjusting rear member with respect to the helmet itself but by the state of the helmet when a wearer is actually driving. For example, when the wearer drives a race autobike, the wearer's head postures forwardly and downwardly a little. Considering such condition, the air flow adjusting rear member is situated on the helmet allowing for the top portion of the air flow adjusting rear member to be parallel to a surface of the road.

On the top portion is formed at least a straight stabilizing portion extending vertically and protruding outwardly at the center in the transverse direction, thereby stabilizing the helmet with respect to traveling direction using the wind stream passing over both sides of the straight stabilizing portion.

On the top portion are formed a plurality of break away inducing portions, each having a stair-shaped ruggedness in the lengthwise direction, at both sides in the transverse direction, for inducing initial break away of the wind a little, thereby allowing for the final break away of the wind to be satisfactorily completed at the back of the top portion and, as a result, reducing overall air resistance.

The air flow adjusting rear member having such features can be mounted to a body of a helmet regardless of whether the helmet is existing or a new one, thereby providing a helmet reducing stress on a wearer's neck muscles.

The air flow adjusting rear member can also be applied to a helmet having an air flow adjusting rear member integrally formed therewith.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 2 is a side elevation of a helmet having a ventilator function, the helmet which a first embodiment of an air flow adjusting rear member of the present invention is mounted to;

FIG. 9 is a side elevation of the helmet having a ventilator function depicted in FIG. 2, which a second embodiment of an air flow adjusting rear member of the present invention is mounted to.

DETAILED DESCRIPTION OF PREFERRED EMBODIMENT

Reference will now be made in detail to the preferred embodiments of the present invention, examples of which are illustrated in the accompanying drawings.

Figure 5:
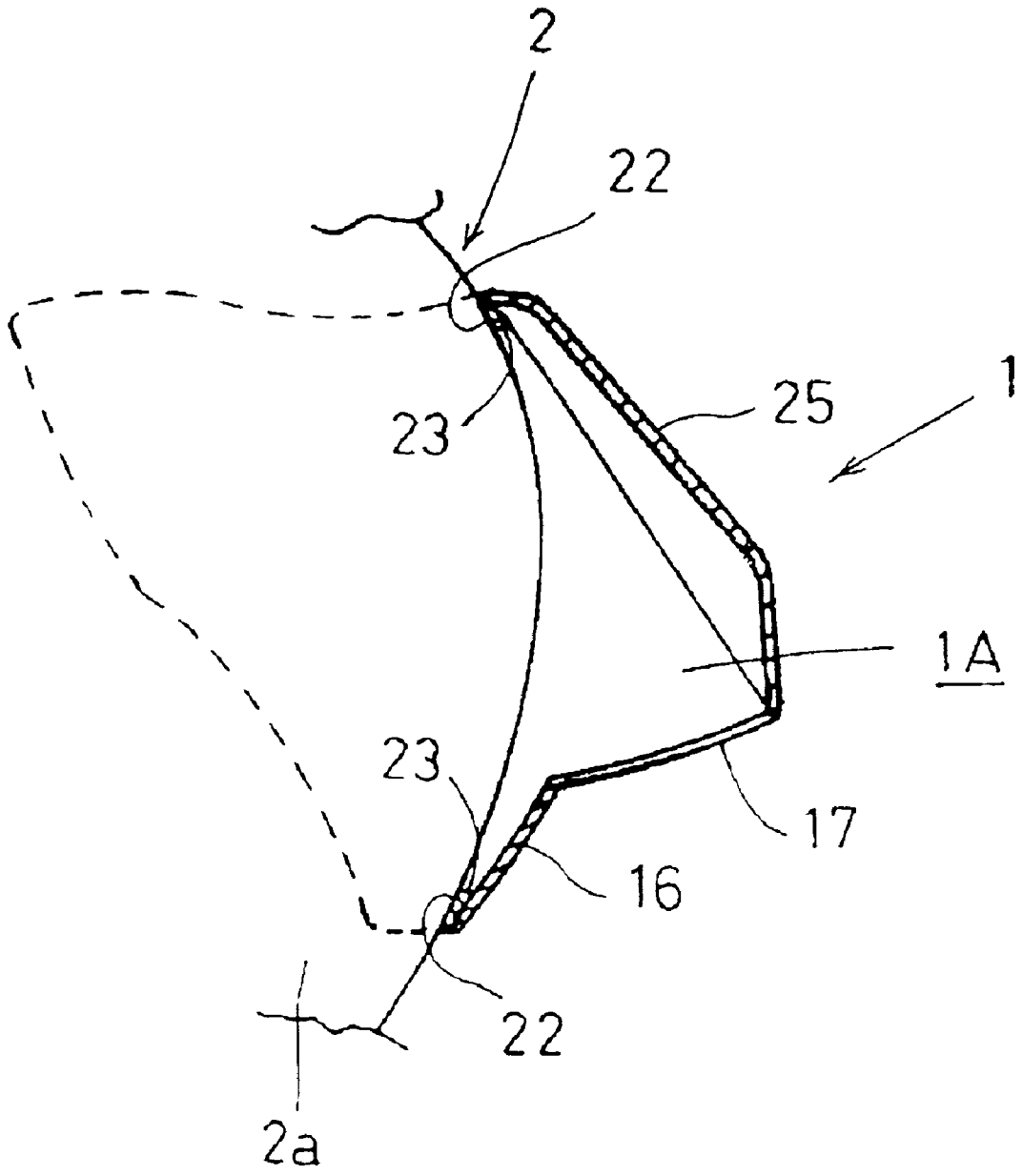
FIG. 5 is a sectional side elevation of the first embodiment of the air flow adjusting rear member which is fastened to a helmet with a double-sided adhesive tape.
Figure 6:
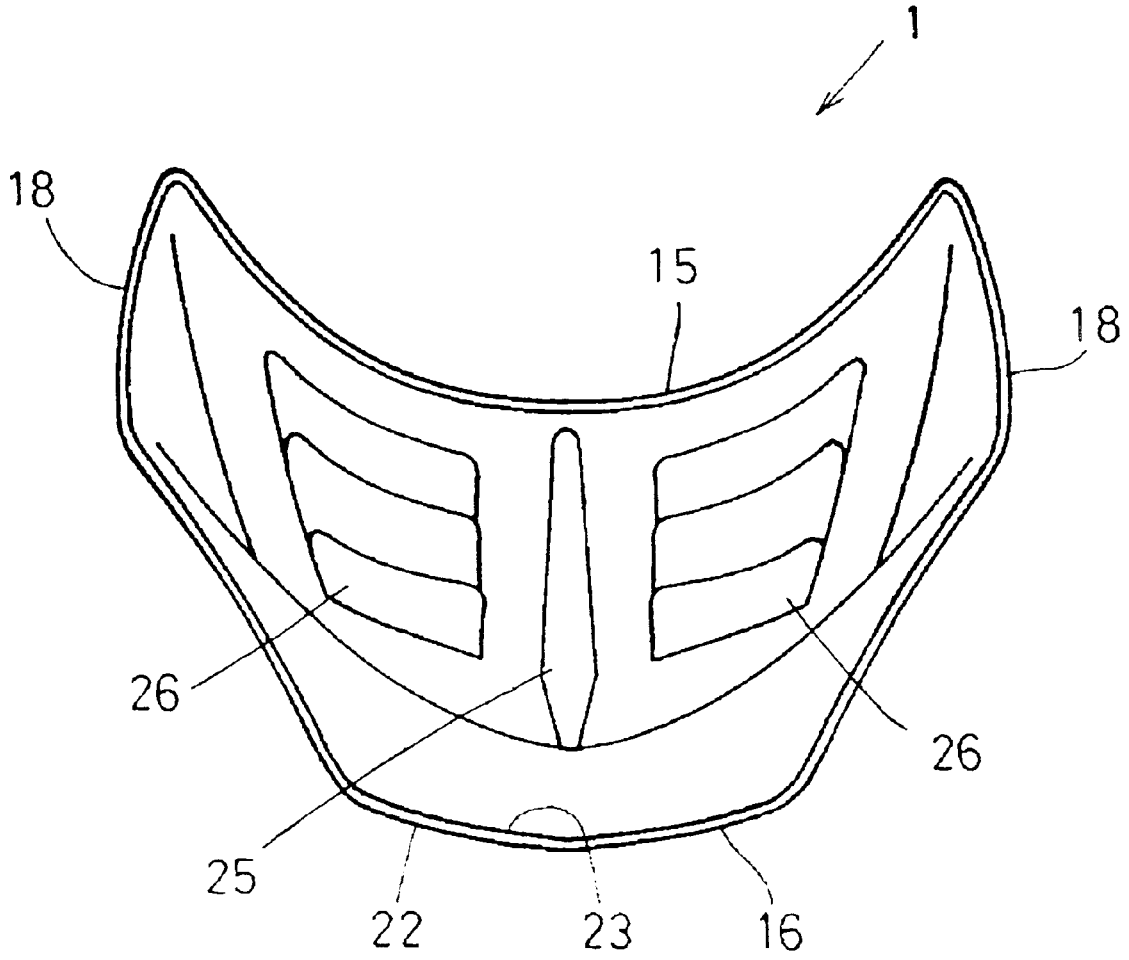
FIG. 6 illustrates an inner side of the first embodiment of an air flow adjusting rear member.

FIGS. 1 to 5 are different views of a helmet 2 to which a first embodiment of an air flow adjusting rear member 1 is mounted according to the present invention. FIG. 6 shows an inner side of the air flow adjusting rear member.

A shape of the helmet 2 to which the air flow adjusting rear member 1 is applicable is not limited. In the first embodiment, the helmet 2 has a ventilator, so space for attachment of the air flow adjusting rear member 1 is limited. The helmet 2 to which the first embodiment is applied is a full face type for a motorcycle. The helmet 2 has shutters 3, 4, and 5 with knobs 3*a*, 4*a*, and 5*a* for sliding operation over the range from the front of a body 2*a* to its top. Air discharging holes 6 and 7 are formed at the back of the top shutter 5 and at each side of a lower back of the body 2*a*. A shield 8 is mounted to be fastened with a hinge 9 and it is moved or fixed by using a handler 10 which is formed near to the hinge 9 of the shield 8.

In such helmet 2, the air flow adjusting rear member 1 is mounted to the helmet 2 at the back of the top shutter 5, namely, the lower back of the body 2*a*.

The air flow adjusting rear member 1 is made of resin such as acrylic resin or polycarbonate resin. The air flow adjusting rear member 1 comprises: a top portion 15 formed to extend backwardly from the mounted site on the helmet 2, for restraining negative pressure (turbulence) from being generated at the lower back of the body 2*a*; a rear portion 16 formed under the top portion 15 to extend upwardly and backwardly from the lower back of the helmet 2; an intermediate plate 17 which intermediates between a lower back rim of the top portion 15 and an upper rim of the rear portion 16; and a side portion 18 which intermediates between the top portion 15 and the intermediate plate 17 at right and left sides.

The top portion 15, rear portion 16, intermediate plate 17, and side portion 18 at each side all have a thickness of 1 mm and are integrally formed, thereby constructing the shell type air flow adjusting rear member 1. As shown in FIG. 5, when the air flow adjusting rear member 1 is mounted to the lower back of the body 2*a*, a cavity 1A is formed. This cavity 1A makes it possible to easily detach the air flow adjusting rear member 1 from the helmet.

Figure 1:
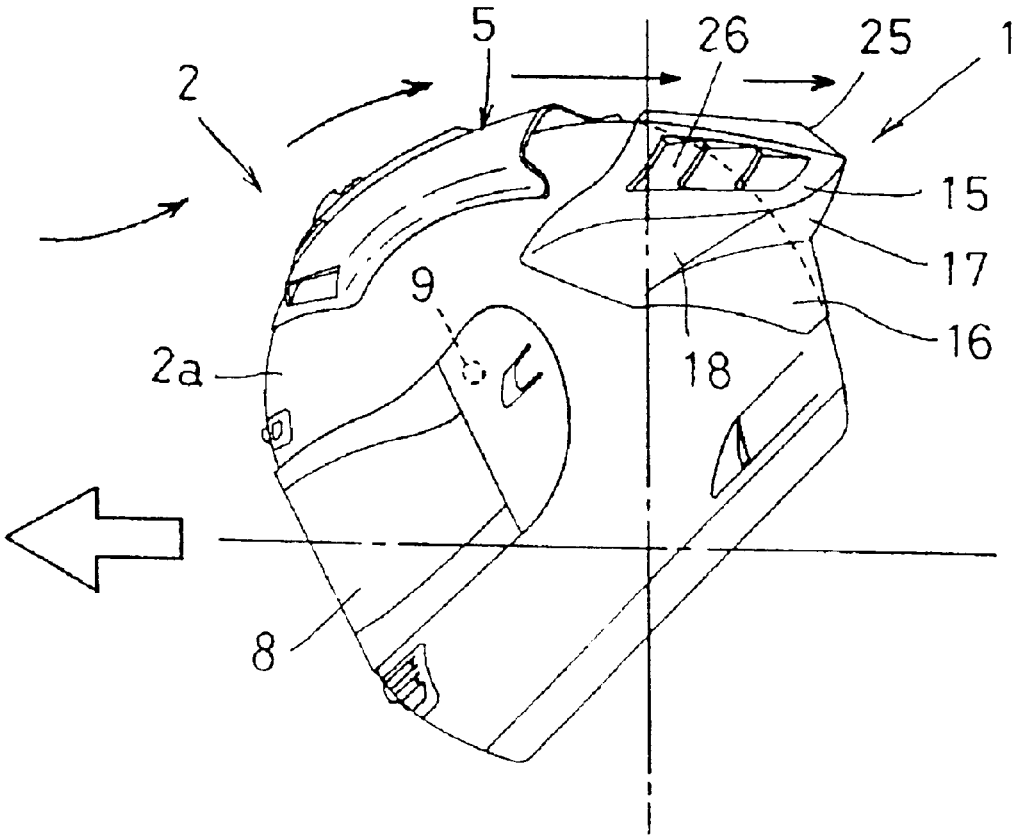
FIG. 1 is a side elevation of a helmet to which an air flow adjusting rear member is mounted according to the present invention.
Figure 2:
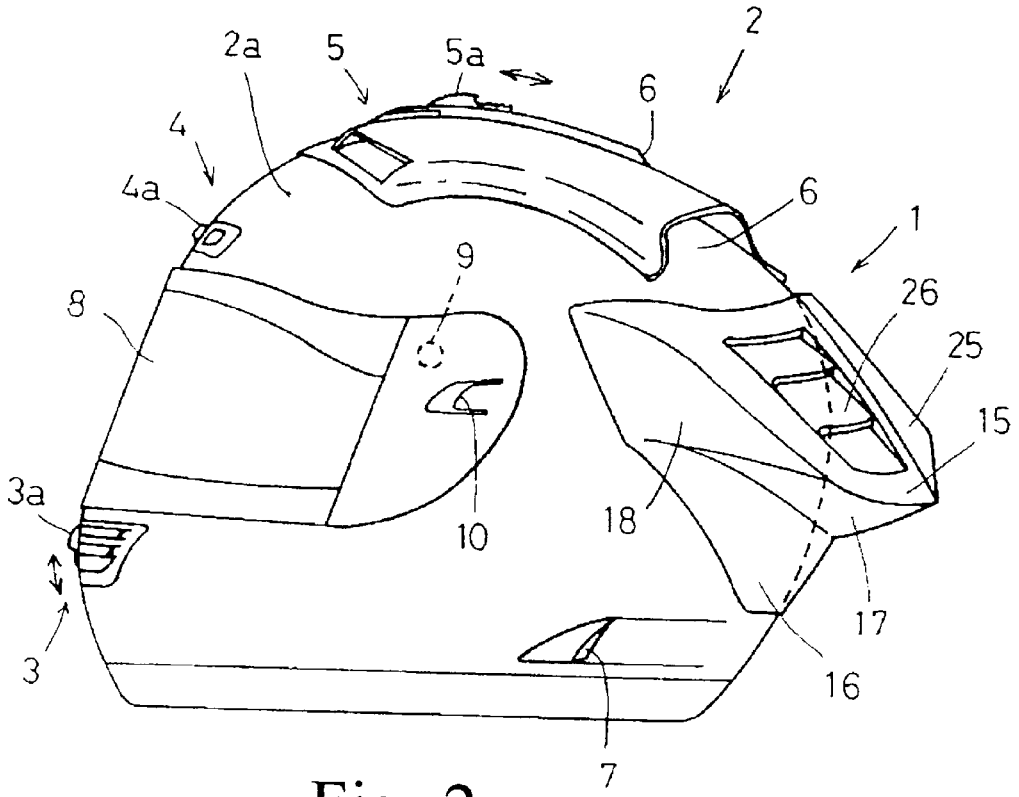
Figure 3:
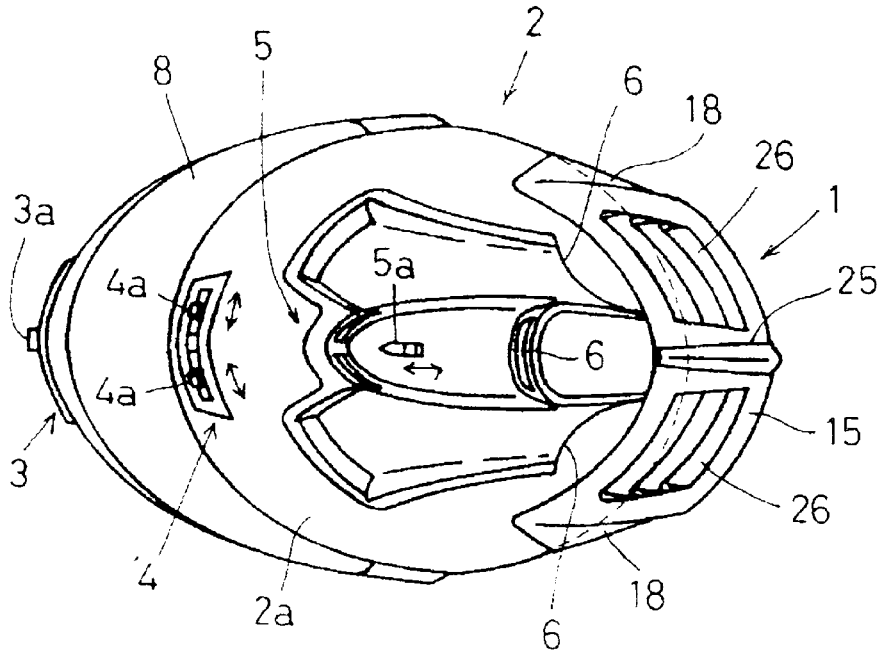
FIG. 3 is a top view of the helmet depicted in FIG. 2.
Figure 4:
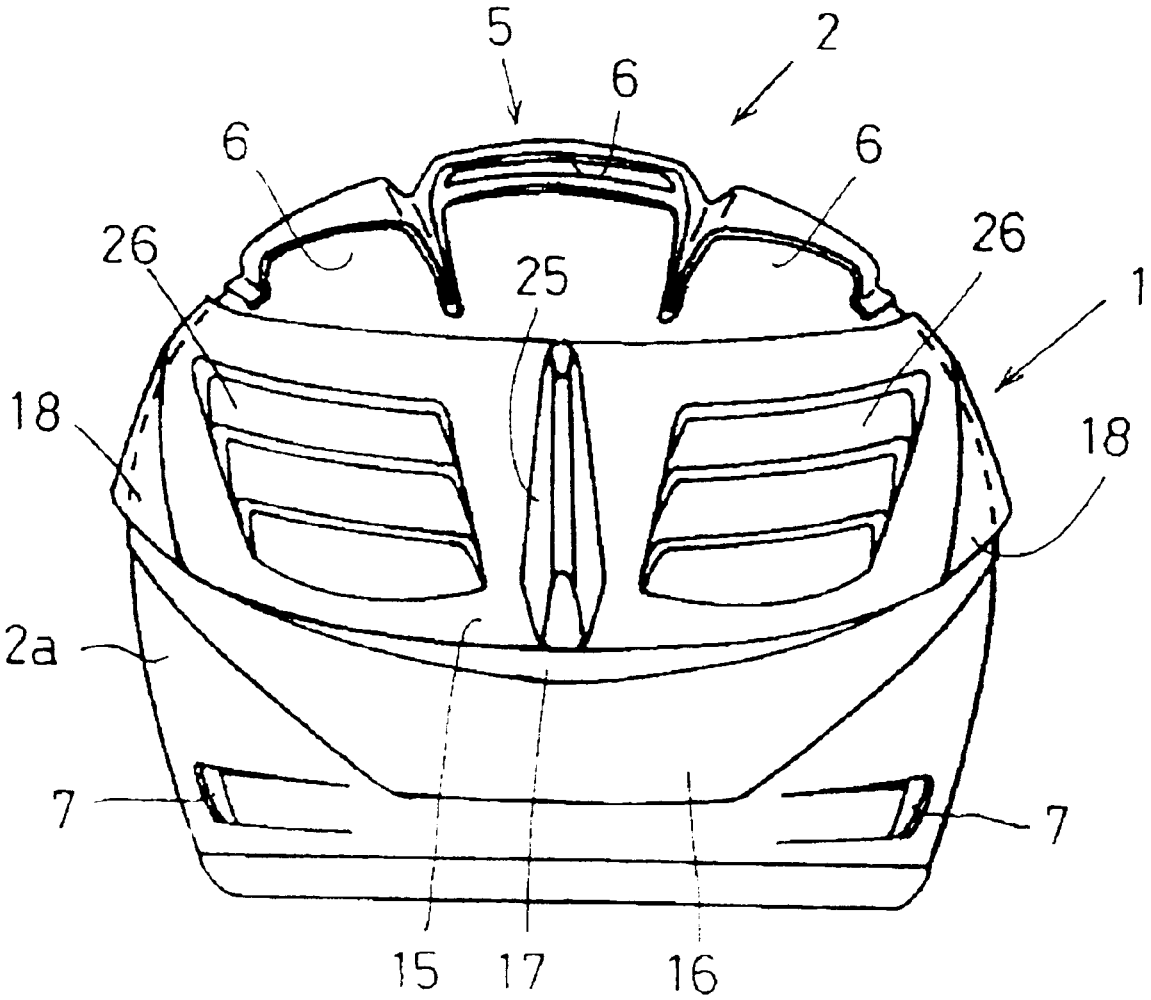
FIG. 4 is a rear view of the helmet depicted in FIG. 2.

The top portion 15 shown in FIG. 3 has a shape similar to that of an eyeshade of a baseball cap. A mounting angle of the air flow adjusting rear member 1 is determined to make the flow of the wind over the top portion 15 approximately parallel to the surface of a road when the air flow adjusting rear member 1 is mounted onto the helmet 2 and a wearer of the helmet 2 is in an actual driving posture as shown in FIG. 1.

In such state, a break away point of the wind above the top portion 15 is located as far back as possible, burden or turbulence generated at the back of the body 2*a* is suppressed, air resistance against the helmet 2 is reduced, and stability of the helmet 2 against the wind is increased, thereby reducing stress on a motorcyclist's neck muscles.

The intermediate plate 17 upwardly slants from the upper rim of the rear portion 16 to the back rim and makes an acute angle with the back of the top portion 15 when the air flow adjusting rear member 1 is viewed from the side.

Such configuration allows for the break away of the wind from the top portion 15 to be satisfactorily completed.

According to the rear view (see FIG. 4), the rear portion 16 has a diamond shape, and according to the side view (see FIG. 2), the side portion 18 has a triangle shape.

The amount of protrusion of the top portion 15 from the helmet 2, the interior angle formed by the top portion 15 and the intermediate plate 17, and the longitudinal lengths of the side portion 18 are selected to be unaffected by the air resistance generated when a motorcyclist changes direction (including turning around a curve) while driving a motorcycle at high speed or when a motorcyclist has a strong wind from the side while driving straight at high speed.

The top portion 15 and the rear portion 16 curve along the rear curve of the helmet 2 so as to achieve a continuous and well fitting contact with the surface of the helmet 2.

As shown in FIG. 6, on circumference of the air flow adjusting rear member 1 formed by continuing edges of the top portion 15, rear portion 16, and left and right side portion 18 is formed an exact fitting edge 22 for allowing for the air flow adjusting rear member 1 to be tightly fastened (exactly fitted without any gaps) to the curved surface of the helmet 2.

The exact fitting edge 22 forms an endless closed loop all over the air flow adjusting rear member 1. Onto the exact fitting edge 22 is applied an adhesive element 23 actually contacting the helmet 2, for fastening the air flow adjusting rear member 1 to the helmet 2. The adhesive element 23 is used in such a manner that one side of a double-sided adhesive tape is stuck on the exact fitting edge 22 in advance. It is preferable that a protecting sheet (not shown in the drawings) of the other side of the tape is left as it is until the air flow adjusting rear member 1 is mounted onto the helmet 1.

Alternatively, a separate adhesive element 23 can be stuck to both the air flow adjusting rear member 1 and the helmet 2 to fasten two of them together just at the time when mounting the air flow adjusting rear member 1 to the helmet 2. The adhesive element 23 is not limited to double-sided tape, but a gluing agent or adhesive can be directly applied to the exact fitting edge 22 to fix the air flow adjusting rear member 1 to the helmet 2.

On the top portion 15 are formed a straight stabilizing portion 25 vertically extending and outwardly protruding at the center in the transverse direction and a plurality of break away inducing portions 26, each having a stair shaped ruggedness in the lengthwise direction, at both sides of the straight stabilizing portion 25.

The straight stabilizing portion 25 guards the wind to a straight way and increases stability of the helmet 2 against the wind. Therefore, multiple straight stabilizing portions 25 can be formed at the right and left sides as well as the center on the top portion 15.

The break away inducing portion 26 induces initial break away of the wind a little, thereby allowing for the final break away of the wind to be satisfactorily completed at the back of the top portion 15.

Each thickness of the top portion 15, rear portion 16, intermediate plate 16, and right and left side portion 18 is not limited to a specific dimension, but it is preferable to make them as thin as they can ensure the intensity necessary for implementing a light air flow adjusting rear member 1.

A molding method for manufacturing such air flow adjusting rear member 1 is not specified, but it is preferable to employ a vacuum molding or a compressed air molding. Either of them is good for making a thickness of 1 mm and molding complicated three-dimensional shapes. Both molding methods can also realize higher precision, thereby reducing manufacturing cost.

Since the adhesive element 23 such as the double-sided adhesive tape is used to fasten the air flow adjusting rear member 1 to the helmet 2, the air flow adjusting rear member 1 can be removed from the helmet 2 when necessary, for example, when the air flow adjusting rear member 1 is broken and needs to be replaced with a new one; when a user (rider) wants to replace the air flow adjusting rear member 1 with another one having a different color, shape, or size; or when a user wants a helmet without the air flow adjusting rear member 1.

The air flow adjusting rear member 1 can be selectively placed at a desired position on the helmet 2, so it can be optimally positioned according to various conditions such as a posture of a rider, an average range of traveling speed, the direction of the wind, and wind pressure.

It is possible to make things, such as stickers, which are put on the surface of the air flow adjusting rear member 1 by a is user according to his/her preference attract people's attention by using transparent or semitransparent resin as the material of the air flow adjusting rear member 1.

Figure 7:
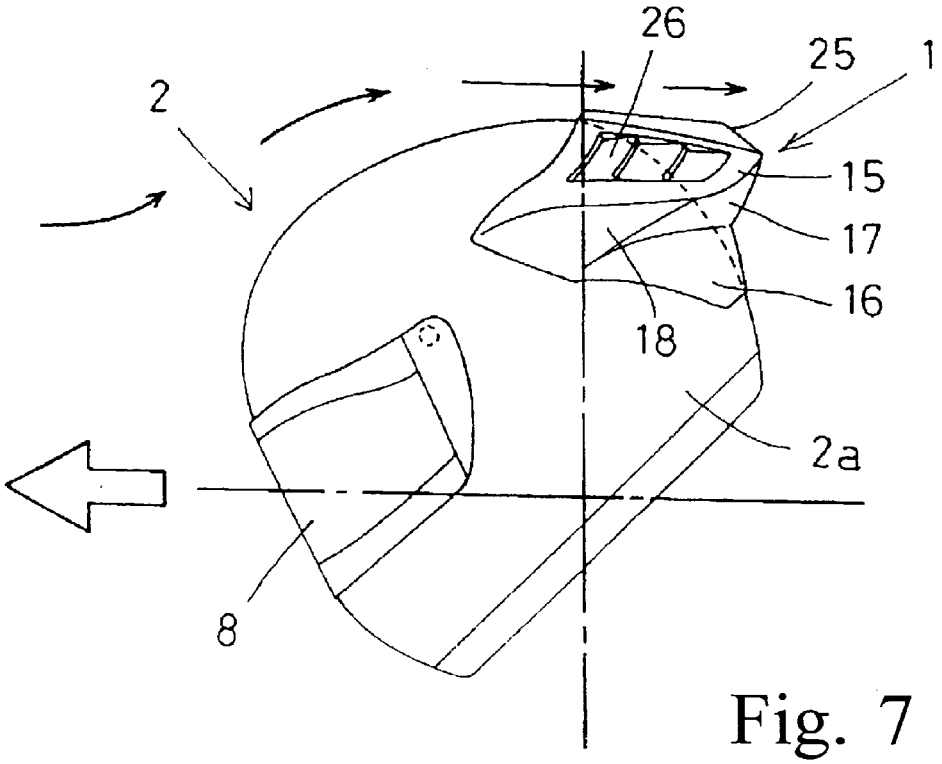
FIG. 7 is a side elevation of a general helmet different from the helmet depicted in FIG. 2, the general helmet which the embodiment of an air flow adjusting rear member of the present invention is mounted to at an optimum location thereon.
Figure 8:
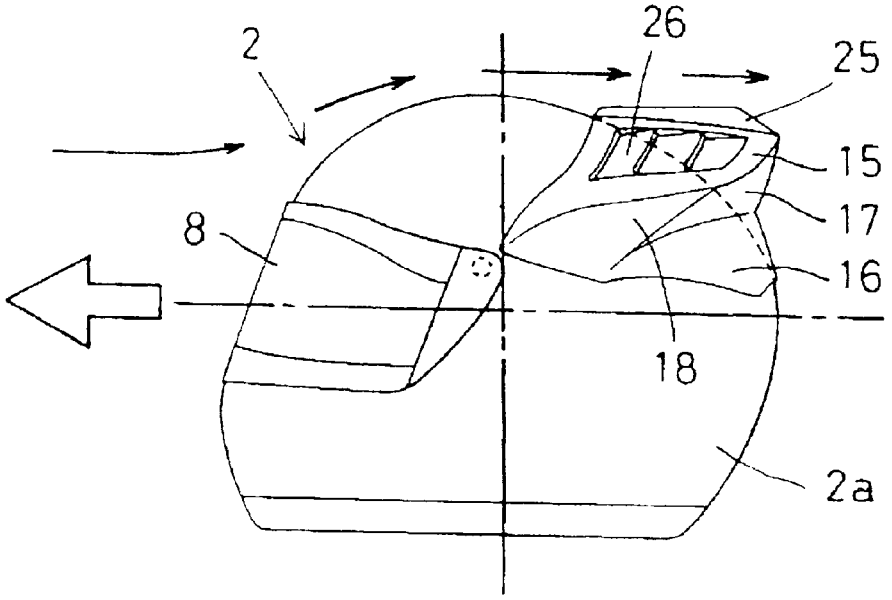
FIG. 8 is a side elevation of the general helmet depicted in FIG. 7, which the embodiment of an air flow adjusting rear member is mounted to at an optimal location when the helmet is used by a user riding a four-wheeled motorcar.

FIGS. 7 and 8 are side elevations of a general full face type helmet 2 to which the first embodiment of the air flow adjusting rear member 1 is mounted, the helmet 2 not having a ventilator function. When there is no obstacles on the surface where the air flow adjusting rear member 1 is mounted in the back part of the helmet 2, the air flow adjusting rear member 1 can be properly mounted such that the helmet 2 can be used when a wearer rides a motorcycle as shown in FIG. 7 and also be mounted to a portion near to the top of the helmet 2 as shown in FIG. 8 for another usage (for example, usage when a wearer rides a four-wheeled car).

The air flow adjusting rear member 1 is preferably made of resin and thin, so it has plasticity and elasticity within a predetermined range. The air flow adjusting rear member 1 thus can be changed in its shape with respect to the helmet 2, thereby making it possible to change the position of the air flow adjusting rear member 1 on the helmet 2.

Figure 9:
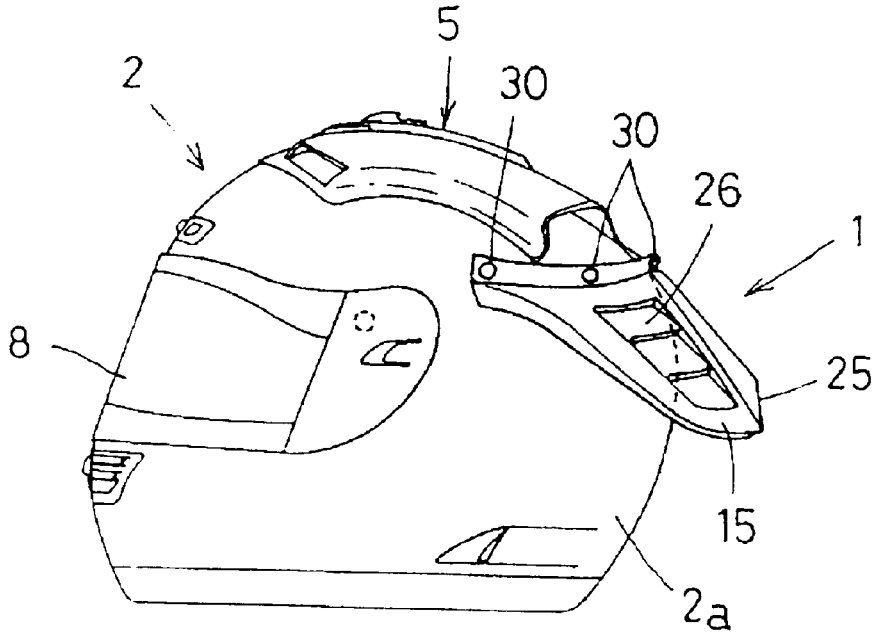

FIG. 9 shows a second embodiment of the air flow adjusting rear member 1 according to the present invention.

In this embodiment, the air flow adjusting rear member 1 mainly comprises the top portion 15 and it can be said that the air flow adjusting rear member 1 does not include the rear portion 16, intermediate plate 17, and side portion 18. The air flow adjusting rear member 1 according to this embodiment has the shape similar to a visor (not shown) which can be attached to the front part of a jet type helmet (not shown).

In this embodiment, the adhesive element 23 is not employed to fasten the air flow adjusting rear member 1 to the helmet 2, but, for example, a snap fastener 30, which is employed when fixing a visor to the front part of the jet type helmet, can be employed. Attachment and removal of the air flow adjusting rear member 1 to and from the helmet 2 can be easily accomplished through the snap fastener 30. The adhesive element (including a double-sided adhesive tape) can also be employed.

Figure 10:
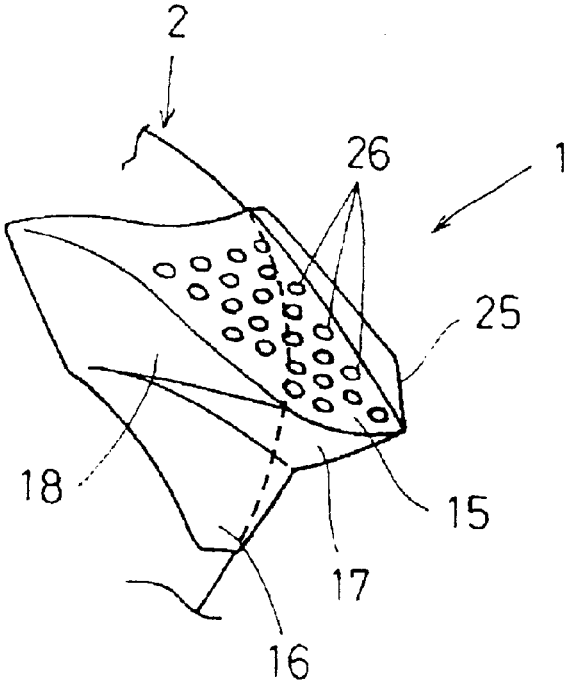
FIG. 10 is a side elevation of a third embodiment of an air flow adjusting rear member according to the present invention.

FIG. 10 shows a third embodiment of the air flow adjusting rear member 1 according to the present invention.

In the third embodiment, multiple spherical concave regions are formed on the right and left sides in the top portion 15 for a function of the break away inducing portion 26, compared with the first embodiment.

The present invention is not limited to the above embodiments.

A detailed appearance or material of the air flow adjusting rear member 1 or how the air flow adjusting rear member 1 is mounted to the helmet 2 can be modified or replaced with another, including a detailed structure of the straight stabilizing portion 25 or the break away inducing portion 26 and existence/non-existence of them.

A fastener, such as a Velcro, can be used to fasten the air flow adjusting rear member 1 to the helmet 2.

A one side adhesive tape can also be used as the adhesive element 23. Specifically, under the state that the air flow adjusting rear member 1 is placed at a predetermined site on the helmet 2, the one side adhesive tape is applied around a circumference where the edge of the air flow adjusting rear member 1 contacts with the surface of the helmet 2.

A helmet where the air flow adjusting rear member 1 is mounted is not limited to a specific one has a specific shape (e.g., jet type) or a specific purpose or an existing/new one. The air flow adjusting rear member 1 can also be mounted to a helmet having the air flow adjusting rear member 1 integrally formed with the helmet at the lower back part of the body 2*a*.

As illustrated above, the air flow adjusting rear member of a helmet according the present invention can be simply and quickly removed from a helmet.

The air flow adjusting rear member can be selectively placed at a desired site on a helmet, thereby realizing optimum use of the helmet under various conditions.

It is not necessary to consider specially increasing a strength of a helmet when the air flow adjusting rear member is attached to the helmet.

It is not required to separately manufacture helmets with and without an air flow adjusting function, thereby solving the problem of a manufacturing cost or distribution.

A user can determine to furnish or not to furnish a helmet with the air flow adjusting rear member without an economical or practical burden.

A helmet having the air flow adjusting rear member at the back of its body (including one having the air flow adjusting rear member integrally formed therewith) does not impose a great stress on a motorcyclist's neck muscles.

It will be apparent to those skilled in the art that various modifications and variations can be made in an air flow adjusting rear member of a helmet of the present invention without deviating from the spirit or scope of the invention. Thus, it is intended that the present invention cover the modifications and variations of this invention provided they come within the scope of the appended claims and their equivalents.

What is claimed is:

1. An air flow adjusting rear member removably mounted on the external surface of a helmet, the member comprising:

a top portion, the top portion having the ability to suppress turbulence and having a lower back rim; and a rear portion, the rear portion extending from the lower back rim of the top portion, the rear portion and the top portion intersecting the external surface of the helmet, the rear portion and the top portion forming an exact fitting edge with the external surface of the helmet;

the top portion and the rear portion having a predetermined degree of plasticity and elasticity sufficient to permit the modification of the fitting edge.

2. The air flow adjusting rear member of claim 1, further comprising:

an adhesive element;

wherein the top portion and the rear portion attach to the adhesive element, and the adhesive element attaches to the external surface of the helmet.

3. The air flow adjusting rear member according to claim 1, additionally comprising:

an intermediate plate;

wherein the rear portion connects to the intermediate plate, and the intermediate plate connects to the lower back rim of the top portion, the top portion being mounted at an acute angle with a tangent plane of the helmet surface sufficient to create a wind stream parallel to a road surface when wind passes above the top of the helmet.

4. An air flow adjusting rear member removably mounted on a helmet, the member comprising:

a top portion, the top portion having the ability to suppress turbulence, the top portion having a straight stabilizing portion, the straight stabilizing portion having two sides, each side having a plurality of break away inducing portions, each break away inducing portion having a stair shaped ruggedness in the direction transverse to the forward direction;

whereby the straight stabilizing portion vertically extends and outwardly protrudes from the external surface of the helmet.

5. An air flow adjusting rear member according to claim 4, wherein the air flow adjusting rear member is formed integrally with the helmet at a lower back part of the helmet.

* * * * *